United States Patent [19]

Hasegawa

[11] Patent Number: 4,528,906

[45] Date of Patent: Jul. 16, 1985

[54] SYSTEM FOR RETAINING STENCIL PRINTING MASTER ON PRINTING DRUM

[75] Inventor: Takanori Hasegawa, Tokyo, Japan

[73] Assignee: Riso Kagaku Corporation, Tokyo, Japan

[21] Appl. No.: 518,421

[22] Filed: Jul. 29, 1983

[51] Int. Cl.[3] ..... B41L 13/00

[52] U.S. Cl. ..... 101/127.1; 101/382 MV; 101/415.1

[58] Field of Search ..... 101/127.1, 128.1, 382 R, 101/382 MV, 383, 415.1; 51/362, 364; 271/DIG. 3; 402/503

[56] References Cited

U.S. PATENT DOCUMENTS

| | | | |
|---|---|---|---|
| 2,229,059 | 1/1941 | Ditty et al. | 101/415.1 |
| 2,231,291 | 2/1941 | Morrison | 101/382 MV |
| 2,237,734 | 4/1941 | Grimsted | 101/129 X |
| 2,305,512 | 12/1942 | Broekhuysen | 101/DIG. 3 |
| 2,730,948 | 1/1956 | Mitchell | 101/415.1 |
| 2,775,199 | 12/1956 | Claff et al. | 101/415.1 |
| 3,017,545 | 1/1962 | Meier | 101/382 MV |
| 3,670,646 | 6/1972 | Welch, Jr. | 402/503 X |
| 3,745,626 | 7/1973 | Bray | 101/382 MV |
| 3,844,461 | 10/1974 | Robison et al. | 101/382 MV |
| 4,194,447 | 3/1980 | Gates | 101/415.1 X |
| 4,273,039 | 6/1981 | Luo et al. | 101/93.02 |

FOREIGN PATENT DOCUMENTS

| | | | |
|---|---|---|---|
| 899942 | 11/1953 | Fed. Rep. of Germany | 101/127.1 |
| 368103 | 11/1906 | France . | |
| 596749 | 10/1925 | France . | |
| 949407 | 7/1949 | France | 101/415.1 |
| 1383860 | 11/1964 | France . | |
| 317491 | 1/1957 | Sweden . | |
| 108479 | 4/1964 | Switzerland . | |
| 253931 | 1/1927 | United Kingdom | 101/127.1 |

OTHER PUBLICATIONS

IBM Technical Disclosure Bulletin; vol. 19, No. 5; Oct. 1976.

Xerox Disclosure Journal; vol. 3, No. 2; Mar./Apr. 1978.

*Primary Examiner*—Edgar S. Burr
*Assistant Examiner*—John A. Weresh
*Attorney, Agent, or Firm*—Stevens, Davis, Miller & Mosher

[57] ABSTRACT

A magnet strip extends along a line on the peripheral surface of a printing drum of a rotary stencil printing device and parallel to the rotational axis thereof. A clamp strip, made of a material which is magnetically attractable, can be selectively positioned as lying against and along the magnet strip with a leading edge of a stencil master for stencil printing interposed therebetween so as to clamp the leading edge of the stencil master to the printing drum, or removed away from the magnet strip so as to release the stencil master. Thereby the stencil master can be conveniently retained to the printing drum in a manner which is suitable for automation, and does not require any reinforced lug portion along the leading edge of the stencil master.

6 Claims, 9 Drawing Figures

SYSTEM FOR RETAINING STENCIL PRINTING MASTER ON PRINTING DRUM

BACKGROUND OF THE INVENTION

The present invention relates to a device for selectively retaining a leading edge of a stencil printing master onto a printing drum of a rotary stencil printing device.

A certain type of rotary stencil printing device which incorporates a hollow printing drum around which a printing stencil master is wrapped is becoming widely used. In such a stencil printing device, printing ink is supplied from within the drum through perforations which extend from its inside space to its outer surface to the radially inner surface of the stencil master wrapped around the drum, and some of this ink passes through multiple perforations in certain previously perforated parts of the stencil master to the radially outward surface of the stencil master, whence this ink is then able to be transferred to the surface of a sheet of printing paper pressed against said outer surface of the stencil master, as the printing drum with the stencil master wrapped around it is rotated.

In such a rotary stencil printing device, a means is required to be provided for retaining a leading edge of the stencil master along a line on the periphery of the printing drum and parallel to the axis of rotation thereof (hereinafter called peripheral live), so that the stencil master is wrapped around the printing drum with a proper tension being applied thereto and the stencil sheet adhered around the printing drum by a viscous ink does not shift relative to the printing drum during the rotary stencil printing process.

For use with currently manufactured conventional stencil printing devices, the leading edge of the stencil master is formed with a reinforced lug portion, made of example of cardboard, and this lug portion is formed with a plurality of perforated engaging holes therein, and along the peripheral line of the printing drum there are provided a number of engagement projections corresponding to these engaging holes, the cardboard lug portion thus being retained against the printing drum along said peripheral line with the engagement projections engaged into the engaging holes. A clamp strip is generally provided to mechanically press the cardboard lug portion mechanically to the printing drum along said peripheral line, or such a clamp strip may be omitted when the engagement between the holes and the projections is formed to be of a non-return type.

These conventional constructions for clamping the leading edge of the stencil master to the printing drum operate generally satisfactorily. However, there is still required a delicate and tedious hand job of properly aligning the lug portion of the stencil master against the peripheral line of the printing drum in a proper position for the engagement projections to be properly engaged into the engaging holes, and this fatally obstructs automation of the process of mounting and demounting of a stencil master to a printing drum. Further, because the stencil master, with this form of stencil retaining system, is required to have the above mentioned reinforcing lug provided along its leading edge, it is not possible to utilize continuous stencil master which is cut off from a roll of stencil master as and when required, but instead the stencil master sheets must be individually manufactured in advance with reinforcing lugs thereon, which is expensive. The use of a headless stencil master, which is typically a piece of plastic material of the thickness of a few tens of microns, without any particular construction for the leading edge thereof, is a very desirable object for implementation in a stencil printing device, and accordingly the prior art schemes for retaining a leading edge of a stencil master onto a printing drum of a rotary stencil printing device are seriously deficient.

SUMMARY OF THE INVENTION

Accordingly, it is the primary object of the present invention to provide a system for retaining a leading edge of a stencil master to a printing drum, which is well adapted to the use of headless stencil masters which have no reinforced lug edge portions.

It is a further object of the present invention to provide such a system for retaining a leading edge of a stencil master to a printing drum, which is well adapted to a rotary stencil printing device in which the stencil masters are cut off from a roll of stencil master as and when required.

It is a further object of the present invention to provide such a system for retaining a leading edge of a stencil master to a printing drum, which does not require any delicate alignment process for the stencil master.

It is a further object of the present invention to provide such a system for retaining a leading edge of a stencil master to a printing drum, which is well adapted to use in an automatic rotary stencil printing device in which the stencil masters are mounted and demounted automatically.

It is a yet further object of the present invention to provide such a system for retaining a leading edge of a stencil master to a printing drum, which is easily operated.

It is a yet further object of the present invention to provide such a system for retaining a leading edge of a stencil master to a printing drum, which is reliable.

It is a yet further object of the present invention to provide such a system for retaining a leading edge of a stencil master to a printing drum, which is relatively cheap in its construction.

It is a yet further object of the present invention to provide such a system for retaining a leading edge of a stencil master to a printing drum, which is relatively cheap in its operation because it is adapted to be employed using a relatively cheap type of stencil master.

According to the most general aspect of the present invention, these and other objects are accomplished by a system for retaining a leading edge of a stencil master to a cylindrical rotatably mounted printing drum of a stencil printing device, comprising: a magnet strip provided in said printing drum to extend along one peripheral line thereof; and a clamp strip made of a material which is magnetically attracted by said magnet strip so as to be held thereon by an attracting magnetic force but is removable from said magnet strip against the attracting magnetic force; whereby said clamp strip in a position as lying against and along said magnet strip retains said leading edge of said stencil master as interposed between said clamp strip and said magnet strip.

According to such an apparatus, when the clamp strip is positioned against the magnet strip with the leading edge of the stencil master in the direction of rotation of the printing drum during stencil printing in between them, the clamp strip is magnetically attracted towards the magnet strip and clamps said leading edge of the stencil master against the printing drum along said generator thereof securely. Then, by a self wrapping effect of the sort well known, the entire stencil master is held against the printing drum as it revolves for stencil printing. According to this construction, it is actually advantageous for the leading edge of the stencil master to be as thin as possible, so that this apparatus is well adapted to clamp a stencil master whose leading edge is made from the same thin plastic material as the rest of the stencil master, and is well adapted to the use of headless stencil masters which have no reinforced lug edge portions, for instance ones which are cut off from a roll of stencil master as and when required. Also, as this apparatus does not require any delicate alignment process for the stencil master, it is well adapted to use in an automatic rotary stencil printing device in which the stencil masters are mounted and demounted automatically. The apparatus itself is of a relatively cheap construction, and further is cheap during use, as it can use continuous sheet type stencil master, which is much cheaper than stencil masters which have special reinforced lug leading edge portions.

Further, according to a more particular aspect of the present invention, the magnet strip may be made of rubberized magnet material. In this case, the risk of damage to the stencil master during securing of it and the risk of the leading edge of the stencil master escaping from the clamping during stencil printing are both reduced, since such rubberized magnet material is relatively soft and also provides an increased friction coefficient.

Further, according to another more particular aspect of the present invention, these and other objects are more particularly and concretely accomplished by a system for retaining a leading edge of a stencil master of the type described above, further comprising a hinge fixed between one axial end of said clamp strip and a point on said printing drum substantially at one axial end of said magnet strip.

According to such an apparatus, the clamp strip may be pivoted around said hinge towards said printing drum so as to lie in its aforesaid position as clamping said stencil master between itself and the magnet strip on the printing drum, or may be pivoted around said hinge away from the printing drum so as to release the stencil master, while its general position relative to the printing drum is preserved by the hinge arrangement. Further, in this case said clamp strip may preferably be made of flexible thin metal material, so that by bending said clamp strip as it is hinged toward and away from the drum the operation of the device is made more conveniently in a gradual manner with a very small force as compared with the total attracting force effected by the magnet strip. In this connection, a knob may be fixed at the other end of said clamp strip, for the convenience of such gradual operation of the clamp strip by the hand of an operator. In this case, the device is particularly adapted to be operated manually. As a further refinement, a recess or depression may be provided in the printing drum, so as to conveniently accomodate said knob when the clamp strip is holding the stencil master to the drum.

Further, according to an alternative particular aspect of the present invention, these and other objects are more particularly and concretely accomplished by a system for retaining a stencil master of the type first described above, further comprising a magnet unit which is capable of selectively exerting either a strong magnetic force at its part facing towards said printing drum which holds said clamp strip by overcoming the attracting magnetic force applied thereto by said magnet strip or a weak magnetic force at its part facing towards said printing drum which releases said clamp strip by being overcome by the attractive magnetic force applied thereto by said magnet strip but is strong enough to hold said clamp strip when not substantially affected by the attractive magnetic force of said magnet strip, and a means for moving said magnet unit towards and away from said printing drum.

According to such an apparatus, when the clamp strip is positioned against the magnet strip with the leading edge of the stencil master in between them and is being thus magnetically held to the printing drum, with the printing drum positioned in such a rotational orientation for the clamp strip and the magnet strip to oppose said magnet unit, after stencil printing has been completed, then the means for moving said magnet unit can be used to move said magnet unit close to said printing drum, and then the magnet unit is caused to exert its stronger magnetic force, which, provided that the various parameters of the apparatus are properly conceived, will pull the clamp strip away from the magnet strip. Then the magnet unit can be moved away from the printing drum, carrying the clamp strip with it, so as to release the leading edge of the stencil master, which can thereafter be removed. On the other hand, when the leading edge of a new stencil master is desired to be secured along said peripheral line of the printing drum for further stencil printing, then said leading edge of the stencil master is brought over said magnet strip on said printing drum, and then said magnet unit is moved by said means for doing so towards said printing drum with the clamp strip still stuck against the magnet unit, and then the magnet unit is caused to exert its weaker magnetic force, which, again provided that the various parameters of the apparatus are properly conceived, will allow the magnet strip to pull the clamp strip away from the magnet unit, so that the stencil master becomes securely fastened to the printing drum as described above, being pinched between the clamp strip and the magnet strip which attract one another magnetically. This particular construction is very suitable for use in an automatic type of stencil printing device in which the stencils are charged and discharged automatically.

Further, according to a yet more particular aspect of the present invention, these and other objects are more particularly and concretely accomplished by such a system for retaining a leading edge of a stencil master as proximately described above, wherein said magnet unit comprises a permanent magnet which is movable between a first position in which said magnet unit exerts said strong magnetic force at its part facing towards said printing drum and a second position in which said magnet unit exerts said weak magnetic force at its part facing towards said printing drum, or alternatively by such a system for retaining a leading edge of a stencil master as proximately described above, wherein said magnet unit comprises an electromagnet which is selectively either strongly energizable so that said magnet unit exerts said strong magnetic force at its part facing towards said printing drum or weakly energizable so that said magnet unit exerts said weak magnetic force at its part facing towards said printing drum, which are suitable alternative possible constructions. In the second of these cases, said magnet unit may further comprise a permanent magnet which substitutes a part of said weak magnetic force exerted by said magnet unit and which is strong enough to hold said clamp strip to said magnet unit when not substantially affected by the attractive magnetic force of said magnet strip.

BRIEF DESCRIPTION OF THE DRAWINGS

The present invention will now be shown and described with reference to several preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and features are denoted by like reference symbols in the various figures thereof, and:

DESCRIPTION OF THE PREFERRED EMBODIMENTS

The present invention will now be described with reference to several preferred embodiments thereof, and with reference to the appended drawings.

EMBODIMENT ONE

Figure 1:
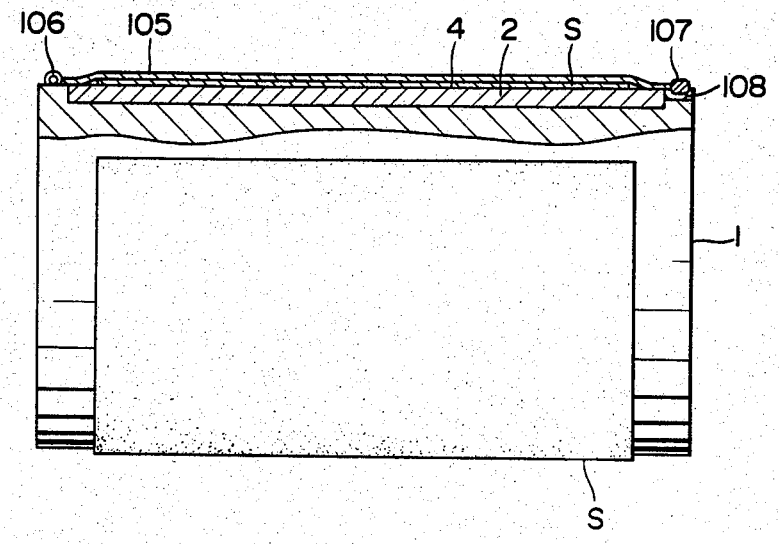
FIG. 1 is a part sectional front elevational view, showing a printing drum of a rotary stencil printing device with a stencil master wrapped around it, the leading edge of said stencil master being secured along a peripheral line of the drum by a first preferred embodiment of the system for retaining a stencil master to a printing drum according to the present invention.
Figure 2:
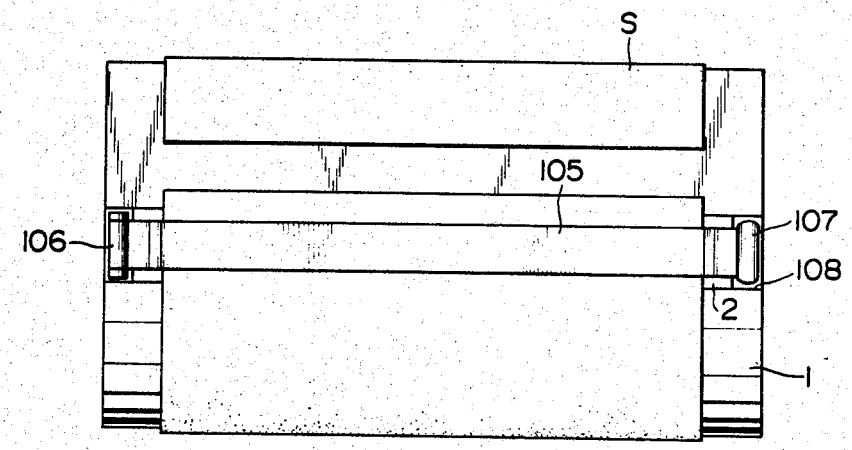
FIG. 2 is a plan view of the printing drum and stencil master and of said first preferred embodiment of the present invention shown in FIG. 1.
Figure 3:
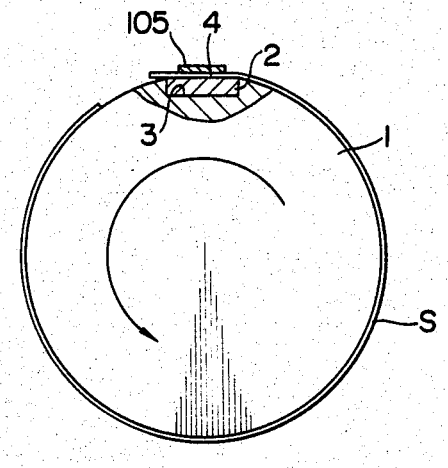
FIG. 3 is a part sectional end elevational side view of the printing drum and stencil master and of said first preferred embodiment of the present invention shown in FIGS. 1 and 2.

FIG. 1 shows a printing drum 1 of a rotary stencil printing device of the type described earlier, having a perforated wall, with a stencil master S wrapped around it. The printing drum 1 is rotatably mounted so as to be able to turn around its axis by a means which is not shown in the figures, and the stencil master S is wrapped around nearly the whole periphery of the printing drum 1, with its leading edge retained and fixed along a generator of the printing drum 1 by a first preferred embodiment of the system for retaining a leading edge of a stencil master to a printing drum according to the present invention. The printing drum 1 has a preferred direction of rotation while the apparatus is being used for printing as indicated by the arrow in FIG. 3, and, by this mere fixing of the leading edge of the stencil master S to the printing drum 1 without any other part of the stencil master S being fixed, said stencil master S is kept securely wrapped around the drum, by a self wrapping effect supported by the adhesive effect of viscous printing ink supplied from the inside of the printing drum through the perforations formed in its wall.

A groove 3 is formed in the outer surface of the printing drum 1, extending approximately along said peripheral line, and in this groove 3 there is embedded a permanent magnet strip 2, so that the outer surface 4 of the magnet strip 2 is substantially flush with the outer surface of the printing drum 1 and extends along said peripheral line thereof. It is desirable that the permanent magnet strip 2 should be made of multipole magnet rubber strip of a per se well known sort, so that the outer surface 4 is soft and provides a high frictional coefficient, and so that the attractive magnetic force exerted by the magnet strip 2 should be effected in a uniform distribution over the whole length of the magnet strip 2. Further, a clamp strip 105 is provided extending generally along the magnet strip 2 with its one axial end pivoted to the drum 1 by a hinge 106, which is fixed at one end of said peripheral line of the printing drum 1, and whose axis is skewed perpendicularly to the central axis of said printing drum 1. The clamp strip 105 is made of a supple magnetically susceptible material which is attracted by a magnetic field, such as for example thin flexible stainless steel strip which in order to have about the proper rigidity should be about 0.1 mm thick, and by the pivoting of the hinge 106 the clamp strip 105 can be laid substantially along the aforesaid generator of the printing drum 1, so as to be attracted by the permanent magnet strip 2 with considerable force. The other end of the clamp strip 105 remote from the hinge 106 is provided with a knob or handle 107, and at the end of the aforesaid generator of the printing drum 1 remote from the hinge 106 there is formed in the surface of said drum 1 a depression 108 adapted to receive said handle 107.

Figure 4:
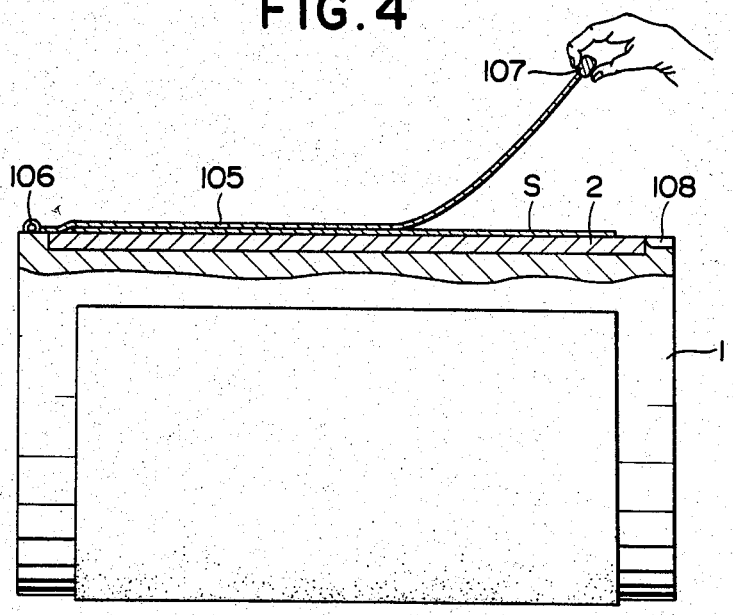
FIG. 4 is a front part sectional elevational view of the printing drum and so on, similar to FIG. 1, showing the system for retaining a stencil master to a printing drum according to the present invention in a position in which the stencil master is partly released.

Thus, when a stencil master S is to be fixed to the printing drum 1 for stencil printing, as shown in FIG. 4 its leading edge is laid along the aforesaid peripheral line of the drum 1, on top of the soft upper surface 4 of the permanent magnet strip 2. This leading edge of the stencil master S is not particularly reinforced, but is just made of the same material as the remainder of the stencil master S, i.e. a thin plastic material. Then the clamp strip 105 is pivoted by the hand of an operator towards the printing drum 1 and is laid on the top of this leading edge of the stencil master S, against said soft upper surface 4 of the permanent magnet strip 2 with the interposition between of said leading edge of the stencil master S. At this time, the knob 107 is received within the depression 108 so as to be conveniently stowed away. Thus, by the mutual attraction between the clamp strip 105 and the permanent magnet strip 2, they mutually clamp said leading edge of the stencil master S securely along said generator of the printing drum 1.

On the other hand, when the stencil master S is to be removed from the printing drum 1 after the stencil printing operation has been completed, in the reverse operation to that shown in FIG. 4 the knob or handle 107 is gripped by the hand of the operator and is lifted from out of the depression 108 away from the printing drum 1, and thus the clamp strip 105 is peeled away from said generator of the printing drum 1, by the magnetic attraction of said strip 105 towards the magnet strip 2 being overcome and eventually by the hinge 106 pivoting, just in the same manner as shown in FIG. 4. Thus the stencil master strip S comes to be no longer clamped between the clamp strip 105 and the magnet strip 2. Subsequently the stencil printing master S, when completely thus released, can be conveniently removed from around the printing drum 1.

The clamp strip 105 is made of suitable elasticity, rigidity, thickness, and so on to be properly flexible, and yet to be well and strongly attracted by the magnet action of the permanent magnet strip 2. And the upper surface 4 of the permanent magnet strip 2 is made to be soft both in order not to damage the stencil master S and in order to have a good frictional coefficient thereagainst. According to this first perferred embodiment, far from any form of reinforced lug or strip being required along the leading edge of the stencil master S, it is actually best for this leading edge to be left naked and thin, in order for the magnetic attraction between the clamp strip 105 and the permanent magnet strip 2 to be maximized by them being as close together as possible. Thus, this system for retaining a stencil master to a printing drum is well adapted to the use of headless stencil masters which have no reinforced lug edge portions, and thus is well adapted to a rotary stencil printing device in which the stencil masters are cut off from a roll of stencil master as and when required. Further, no delicate alignment process from the stencil master is required, during use of the retaining system therefor according to the present invention. Accordingly, this first preferred embodiment is very easy to use. As will be understood, of course, it is only practicable to operate this first preferred embodiment by hand.

EMBODIMENT TWO

Figure 5:
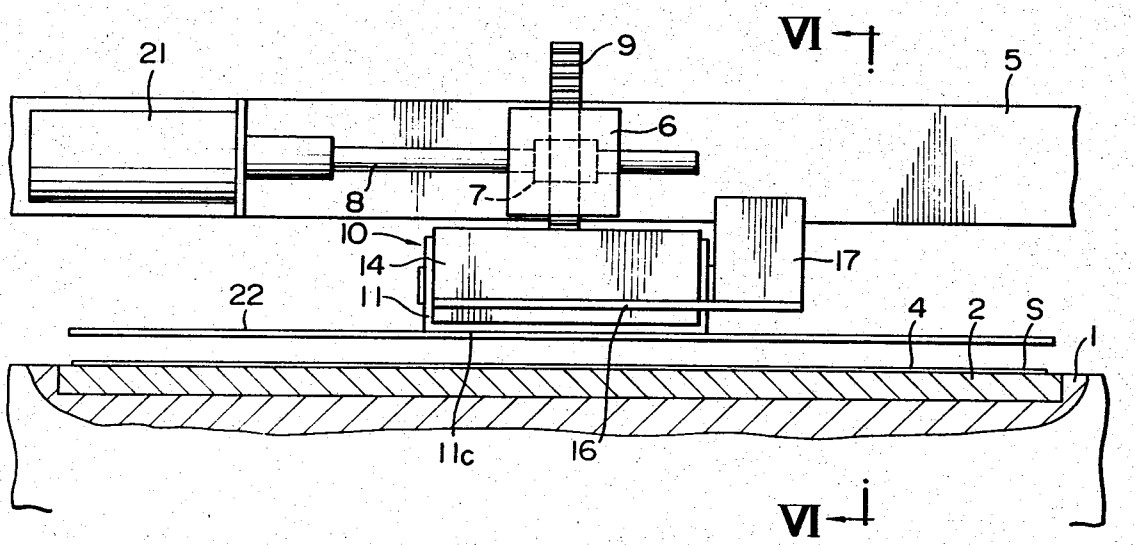
FIG. 5 is a front part sectional elevational view, similar to FIG. 1 for the first preferred embodiment, but this time only showing a part of a printing drum of a rotary stencil printing device with a stencil master wrapped around it, the leading edge of said stencil master being in the process of being secured along a peripheral line of the drum by a second preferred embodiment of the system for retaining a stencil master to a printing drum according to the present invention.

FIG. 5 is a part sectional front elevational view, similar to a part of FIG. 1, of part of a printing drum of a rotary stencil printing device with a stencil master wrapped around it, the leading edge of said stencil master being secured along a peripheral line of the drum by a second preferred embodiment of the system for retaining a stencil master to a printing drum according to the present invention. In this figure, parts of the second preferred embodiment shown, which correspond to parts of the first preferred embodiment shown in FIGS. 1 through 4, and which have the same functions, are designated by the same reference numerals and symbols as in those figures.

In this second preferred embodiment, which as will be seen hereinafter is particularly adapted for fully automatic operation, a printing drum 1 of a rotary stencil printing device of the type described earlier, with a stencil master S wrapped around it, is again rotatably mounted so as to be able to turn around its axis by a means which is not shown in the figures, and the stencil master S is again wrapped around nearly the whole periphery of the printing drum 1 (although this is not particularly shown in the figures), with its leading edge retained and fixed along a peripheral line of the printing drum 1. The printing drum 1 has a preferred direction of rotation while the apparatus is being used for printing as indicated by the arrow in FIG. 6, and again, by this mere fixing of the leading edge of the stencil master S to the printing drum 1 without any other part of the stencil master S being fixed.

In this second preferred embodiment, again a groove 3 is formed in the outer surface of the printing drum 1, extending approximately along said one of the peripheral line thereof, and in this groove 3 there is again embedded a permanent magnet strip 2, so that the outer surface 4 of the magnet strip 2 is substantially flush with the outer surface of the printing drum 1 and extends along said generator thereof. This outer surface 4 of the permanent magnet strip 2 is again soft; and again the permanent magnet strip 2 may be desirably made out of multipole magnet rubber strip of a per se well known sort. Thus, in this second preferred embodiment, the printing drum 1 and the associated inlaid magnet strip 2 are very similar to those of the first preferred embodiment, except that no clamp strip is hinged to the drum. Instead, the function thereof is provided by a more specialized construction, which will now be explained.

Figure 6:
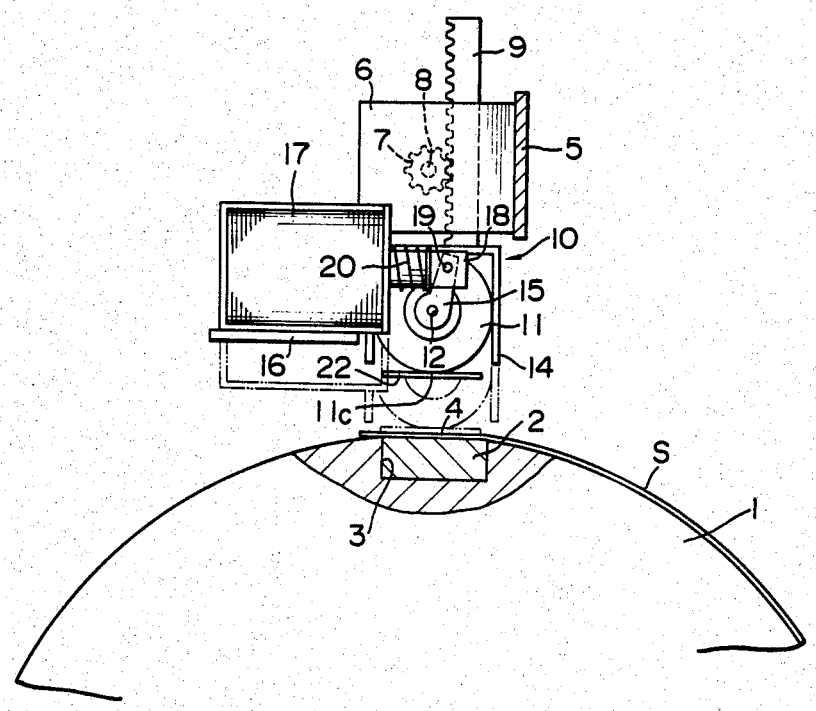
FIG. 6 is a part sectional end elevational side view of said part of the printing device, similar to FIG. 3 relating to the first preferred embodiment, taken along the lines VI—VI in FIG. 5.

Generally above the printing drum 1 from the point of view of FIGS. 5 and 6, and extending parallel to its axis opposed to said peripheral line thereof when the drum 1 is in, with its position as shown in FIGS. 5 and 6, there is provided a support frame 5, to which there is fitted a gear box 6. This gear box 6 rotatably supports a shaft 8 which extends in the horizontal direction from the point of view of the figures, on which a pinion 7 is fixedly mounted within the gear box 6, and also slidably supports a rack 9, which extends in the vertical direction from the point of view of the figures, and on which are formed a plurality of teeth which are meshed with the teeth of the pinion 7. The shaft 8 is driven by an electric motor 21, which is controlled as will hereinafter be explained, and at the lower part of the rack 8 there is fixedly mounted a magnet unit, generally designated by the reference numeral 10. Thus, by selectively operating the electric motor 21 and by thereby selectively rotating the shaft 8, the rack 9 may be driven upwards and downwards, as desired, and the magnet unit 10 either may be lowered downwards in the figures towards the printing drum 1 to a position shown by phantom lines in FIG. 6 in which its lower surface is very close to the surface of said printing drum 1, or may be raised upwards in the figures away from the printing drum 1 to a position shown by solid lines in FIG. 6 in which its said lower surface is some distance away from the surface of said printing drum 1.

The magnet unit 10 is of a particular construction which will now be explained, and its function is that, according to selective control thereof, it can either provide at its underside in the drawings a magnetic field of a first intensity, or a magnetic field of a second intensity which is substantially greater than said first intensity. In detail, the magnet unit 10 comprises a cylindrical sleeve 11 with a cylindrical permanent magnet 13 mounted in it, supported by a bracket 14.

Figure 7:
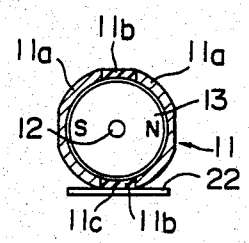
FIG. 7 is a transverse cross sectional view of a sleeve of a magnet unit which is comprised in said first preferred embodiment of the present invention, taken in a plane perpendicular to its central axis, showing said magnet unit in a first operational state in which it is providing a relatively high magnetic force.
Figure 8:
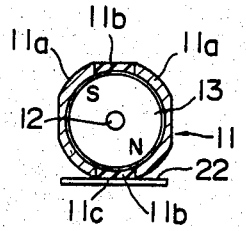
FIG. 8 is another transverse cross sectional view of said sleeve of said magnet unit, similar to FIG. 7 and taken in the same plane, showing said magnet unit in a second operational state in which it is providing a relatively low magnetic force.

The sleeve 11 is of a particular construction which is best shown in FIGS. 7 and 8, which are transverse cross sectional views of said sleeve 11 taken in a plane perpendicular to its central axis, showing it in two different operational states. In detail, as can be seen from these transverse cross sections, the sleeve 11 is formed from two semicylindrical members 11*a*, which are formed rather like portions of gutter being semicircular in their cross sections, and two arcuate members 11*b*, which are formed like extended plate strips and each one of the long edges of each of which is joined to one of the long edges of one of the semicylindrical members 11*a*. Thus, the entire sleeve member 11 is formed as a hollow cylindrical tube. The semicylindrical shaped members 11*a* are formed of a ferromagnetic material, and the arcuate members 11*b* are formed of a paramagnetic material. The sleeve member 11 is formed with a flat bottom face 11*c* which is provided substantially by one of the arcuate members 11*b* located at the lower side thereof.

The cylindrical permanent magnet 13, mounted within the central hole of the sleeve 11, is fixedly secured to a rotatably mounted shaft 12 so as to be rotatable aboout its central axis. The cylindrical permanent magnet 13 is magnetized in such an orientation that its north pole extends along a portion of its outer cylindrical surface and its south pole extends along the diametrically opposed portion of said surface, as indicated in FIGS. 7 and 8. And to one end of the shaft 12 which projects from the end of the sleeve 11 there is fixed one end of a sideways extending lever 15, the other end of which is pivotally coupled by a pin 19 to an end of a plunger 18 of a solenoid device 17 which is mounted via a bracket 16 to the bracket 14. A compression coil spring 20 biases the lever 15 and the permanent magnet 13 in the clockwise direction as seen in FIG. 6. Thus, when the solenoid device 17 is supplied with actuating electrical energy, against the biasing action of the compression coil spring 20 the lever 15 and the shaft 12 and the permanent magnet 13 are positioned to a first position as shown in FIG. 7 in which the orientation of the line joining the north and south poles of the permanent magnet 13 is substantially horizontal and in which said permanent magnet 13 provides a magnetic field at the lower surface 11*c* of the sleeve 11 of a certain first relatively high intensity; but on the other hand, when the solenoid device 17 is not supplied with actuating electrical energy, by the biasing action of the compression coil spring 20 the lever 15 and the shaft 12 and the permanent magnet 13 are positioned to a second position as shown in FIG. 8 in which the orientation of the line joining the north and south poles of the permanent magnet 13 is tilted and in which said permanent magnet 13 provides a magnetic field at the lower surface 11*c* of the sleeve 11 of a certain second relatively low intensity.

Further a clamp strip 22 is provided extending generally in the longitudinal direction of the printing drum 1, but, in contradistinction to the case in the first preferred embodiment of the present invention described above, this clamp strip 22 in this second preferred embodiment is not in any way pivoted to the printing drum 1, but is quite physically separate therefrom. The clamp strip 22 is made of a magnetically susceptible which is attracted by a magnetic field, such as for example thin stainless steel strip, and in this second preferred embodiment is quite stiff. Thus, when the clamp strip 22 is laid substantially along the magnet strip 2, in the position shown in FIG. 4 by the phantom lines, it is attracted by the upper surface 4 of the magnet strip 2 inlaid into said printing drum 1 with a considerable force. On the other hand, when the clamp strip 22 is laid against the lower surface 11*c* of the sleeve 11, in the position shown in FIG. 6 by the solid line and in FIG. 5, it is attracted by said bottom surface 11*c* again with a considerable force.

The solenoid device 17 and the electric motor 21 are selectively supplied with actuating electrical energy from a controller which will not be particularly described herein with regards to its structure but only in terms of its appropriate function, since these functions are periodic operations which can be performed by a controller of a per se well known type employing conventional sequence control technology, and thus various detailed structures therefor will be easily supplemented, if required, by one of ordinary skill in the relevant art.

The device described above operates as follows.

First, when a stencil master S is to be fixed to the printing drum 1 for stencil printing, the electric motor 21 is operated so as, via the shaft 8, the gearbox 6, and the rack 9, to raise the magnet unit 10 to its position as shown in FIGS. 5 and 6 by the solid lines in which the lower surface 11*c* of the sleeve 11 is some distance away from the surface of the printing drum 1, with the clamp strip 22 magnetically attached to said lower surface 11*c* of the sleeve 11 and removed from the permanent magnet strip 2, but parallel thereto. At this time the solenoid device 17 is not supplied with actuating electrical energy, so that as explained above the permanent magnet 13 of the magnet unit 10 is in its second rotary position as shown in FIG. 8, so that the magnetic field at said lower surface 11*c* of the sleeve 11 is of said certain second relatively low intensity; and the printing drum 1 is positioned to its position with said permanent magnet strip 2 opposed to the magnet unit 10 and the clamp strip 22. Next, the leading edge of the stencil master S is laid along the aforesaid generator of the drum 1, on top of the soft upper surface 4 of the permanent magnet strip 2; this may be done mechanically and automatically, although the details are not shown herein because they are not part of the present invention. This leading edge of the stencil master S again is not particularly reinforced, but is just made of the same material as the remainder of the stencil master S, i.e. a thin plastic material. When this operation is completed, the fact is detected by a sensor not shown in the figure, associated with the abovementioned sequence control device for the electric motor 21 and the solenoid device 17, and next the electric motor 21 is activated so as to lower the magnet unit 10 downwards in the figures towards the printing drum 1 to the position shown by phantom lines in FIG. 6 in which the lower surface 11*c* of the sleeve 11 is very close to the surface of said printing drum 1 with of course the clamp strip 22 still stuck onto said lower surface 11*c* and with the leading edge of the stencil master S interposed between the clamp strip 22 and the printing drum 1, and in this condition the magnetic attraction of the upper surface 4 of the magnet strip 2 overcomes the magnetic attraction of the magnet unit 10 and retains the clamp strip 22 thereto and away from said magnet unit 10, so that the clamp strip 22 comes to be laid on the top of the leading edge of the stencil master S, against said soft upper surface 4 of the permanent magnet strip 2 with the interposition of said leading edge of the stencil master S, as shown in FIG. 6 by the phantom lines. Thus, by the mutual attraction between the clamp strip 22 and the permanent magnet strip 2, they mutually clamp said leading edge of the stencil master S securely along said generator of the printing drum 1. Finally, the electric motor 21 is again operated so as, via the shaft 8, the gearbox 6, and the rack 9, to raise the magnet unit 10 back to its position as shown in FIGS. 5 and 6 by the solid lines in which the lower surface 11*c* of the sleeve 11 is some distance away from the surface of the printing drum 1.

On the other hand, when the stencil master S is to be removed from the printing drum 1 after the stencil printing operation has been completed, while the magnet unit 10 is in its position as shown in FIGS. 5 and 6 by the solid lines, with the clamp strip 22 magnetically attached to the permanent magnet strip 2, with the leading edge of the stencil master S being clamped therebetween, the printing drum 1 is positioned to its position as shown in the figures with said permanent magnet strip 2 and said clamp strip 22 opposed to the magnet unit 10. At this time the solenoid device 17 is supplied with actuating electrical energy, so that the permanent magnet 13 is in its first rotary position as shown in FIG. 7, so that the magnetic field at the lower surface 11*c* of the sleeve 11 is of said certain first relatively high intensity. Next, the electric motor 21 is activated so as to lower the magnet unit 10 downwards in the figures towards the printing drum 1 to the position shown by phantom lines in FIG. 6 in which the lower surface 11*c* of the sleeve 11 is very close to or in contact with the clamp strip 22 still stuck to the printing drum 1, and in this condition the magnetic attraction of the magnet strip 2 is overcome by the magnetic attraction of the magnet unit 10, so that the clamp strip 22 is removed away from the permanent magnet strip 2, and comes to be held against said lower surface 11*c* of the sleeve 11 of the magnet unit 10. Finally, the electric motor 21 is again operated so as, via the shaft 8, the gearbox 6, and the rack 9, to raise the magnet unit 10 back to its raised position, carrying the clamp strip 22 with it, the leading edge of the stencil master S being released from being retained to the permanent magnet strip 2 of the printing drum 1. Subsequently, as the printing drum 1 is rotated, the stencil master S is removed from the drum 1; this may be done mechanically and automatically, by for example a pick off or peeling off claw, although the details are not shown herein because they are not part of the present invention.

EMBODIMENT THREE

Figure 9:
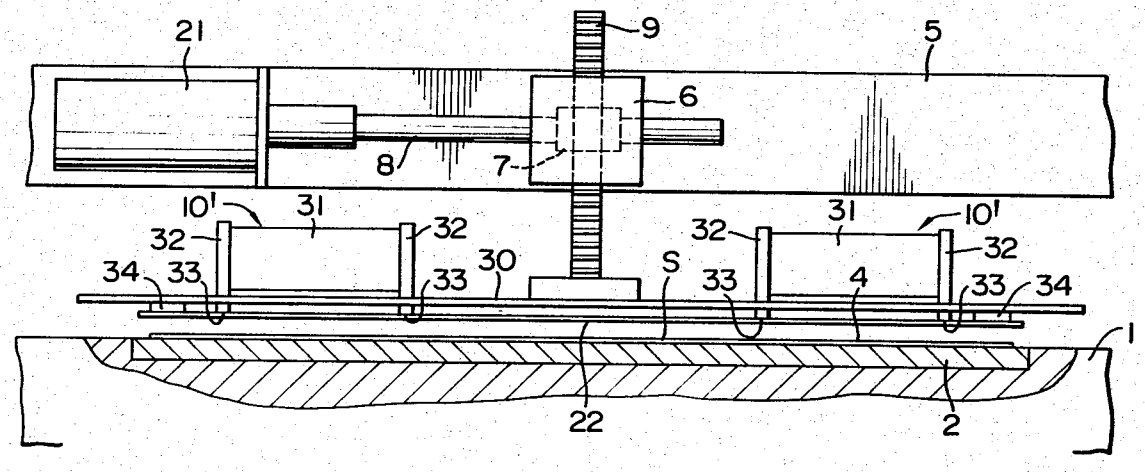
FIG. 9 is a front part sectional elevational view, similar to FIG. 5 for the second preferred embodiment, showing a part of a printing drum of a rotary stencil printing device with a stencil master wrapped around it, the leading edge of said stencil master being in the process of being secured along a peripheral line of the drum by a third preferred embodiment of the system for retaining a stencil master to a printing drum according to the present invention.

FIG. 9 is a front part sectional elevational view, similar to FIG. 5 for the second preferred embodiment, showing a part of a printing drum of a rotary stencil printing device with a stencil master wrapped around it, the leading edge of said stencil master being in the process of being secured along a generator of the drum by a third preferred embodiment of the system for retaining a stencil master to a printing drum according to the present invention. In this figure, parts of the third preferred embodiment shown, which correspond to parts of the first and second preferred embodiments shown in FIGS. 1 through 8, and which have the same functions, are designated by the same reference numerals and symbols as in those figures.

This third preferred embodiment of the present invention is similar to the second preferred embodiment described above and shown in FIGS. 5 through 8, except that the structure of the magnet unit 10' is different from that of the former magnet unit 10. In detail, the lower end of the rack 9 is fixed to a support plate 30 which extends parallel to the axis of the printing drum 1. To this support plate 30 there are fixed two electromagnets 31, each of which has two pole pieces 32, each of which has a bottom surface 33 which projects downwards in the figure through the support plate 30 and faces the permanent magnet strip 2, which is inlaid into the printing drum 1 as before. Further, to the support plate 30 there are fixed two relatively weak permanent magnets 34, each of which, again, has a bottom surface which projects downwards in the figure and faces the permanent magnet strip 2.

Thus, the function of this magnet unit 10' is similar to that of the magnet unit 10 of the second preferred embodiment described above, but is obtained via a different construction. That is, when the electromagnets 31 are supplied with actuating energy, they produce a magnetic field at the lower surface of the magnet unit 10', in combination with the permanent magnets 34, of a certain first relatively high intensity; but on the other hand, when the electromagnets 31 are not supplied with actuating electrical energy, they produce substantially no magnetic field of their own at the lower surface of the magnet unit 10', and thus substantially only the magnetic field of the permanent magnets 34 is present at said lower surface, and is of a certain second relatively low intensity. The electromagnets 31 are controlled by the above mentioned controller, as in the case of the second preferred embodiment.

It will be apparent that this third preferred embodiment operates in substantially the same manner as the above described second preferred embodiment, by the two electromagnets 31 being selectively energized or deenergized just like the solenoid device 17 in the second preferred embodiment, so as to provide a strong magnetic attraction or a weak magnetic attraction to the clamp strip 22. Therefore, no further repetitive explanations of the operation of this third preferred embodiment will be made, in order to avoid redundancy of description.

Although the present invention has been shown and described with reference to several preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiments, or of the drawings, but solely by the scope of the appended claims, which follow.

What is claimed is:

1. A system for selectively retaining a leading edge of a stencil master on a cylindrical drum of a stencil printing device having a frame, said drum being supported by said frame to be rotatable around a central axis thereof, comprising:

a magnet strip carried by said cylindrical drum to extend along a surface portion thereof substantially parallel to the central axis of said cylindrical drum;

a clamp strip made of a material which is magnetically attracted by said magnet strip so as to be held thereon by an attracting magnetic force and removable from said magnet strip against the attracting magnetic force;

a magnet unit, and means supporting said magnet unit for movement between a first position in which said magnet unit substantially contacts said clamp strip which is magnetically held by said magnet strip and a second position in which said magnet unit is spaced from said magnet strip by a distance so that said magnet unit can stably hold said clamp strip by a magnetic force which is weaker than the magnetic force applied to said clamp strip by said magnet strip when said magnet unit is in said first position; said magnet unit including means independent of its position relative to said cylindrical drum to selectively exert either a strong magnetic force at the portion of said magnet unit which is closest to said cylindrical drum, which holds said clamp strip, to overcome the attracting magnetic force applied to said clamp strip by said magnet strip, regardless of the position of said magnet unit relative to said cylindrical drum or to exert a weak magnetic force at the portion of said magnet unit which is closest to said cylindrical drum to permit said clamp strip to be held by the attractive magnetic force applied thereto by said magnet strip when said magnet unit is moved to said first position, and strong enough to hold said clamp strip when said magnet unit is moved away from said first position and therefor not substantially affected by the attractive magnetic force of said magnet strip;

the leading edge of said stencil master being retained on said cylindrical drum when said leading edge is placed over said magnet strip and said clamp strip is held by the magnetic force of said magnet strip, said leading edge being released from said cylindrical drum by said magnet unit when the portion of said magnet unit which is closest to said cylindrical drum is switched to said strong magnetic force and said clamp strip is transferred from said magnet strip to said magnet unit.

2. A system according to claim 1, wherein said magnet unit comprises a permanent magnet which is movable relative to said part of said magnet unit facing towards said printing drum between a first relative position in which said magnet unit exerts said strong magnetic force at said part thereof facing towards said printing drum and a second relative position in which said magnet unit exerts said weak magnetic force at said part thereof facing towards said printing drum.

3. A system according to claim 1, wherein said magnet unit comprises an electromagnet which is selectively either strongly energizable so that said magnet unit exerts said strong magnetic force at said part thereof facing towards said printing drum or weakly energizable so that said magnet unit exerts said weak magnetic force at said part thereof facing towards said printing drum.

4. A system according to claim 3, wherein said magnet unit further comprises a permanent magnet which provides a part of said strong and weak magnetic forces exerted by said magnet unit.

5. A system according to claim 1, wherein said supporting means for said magnet unit comprises a frame element supported by the frame of said stencil printing device, a pinion supported to be rotatable along its central axis by said frame element, a rack supported by said frame element to be slidable relative to said frame element as meshed with said pinion, said rack being connected with said magnet unit at one end thereof.

6. A system according to claim 5, further comprising a reversible electric motor supported by said frame element so as to drive said pinion selectively in either rotational direction.

* * * * *